US007975319B2

(12) United States Patent
Moore et al.

(10) Patent No.: US 7,975,319 B2
(45) Date of Patent: Jul. 12, 2011

(54) HELMET FASTENING ELEMENT

(75) Inventors: Barclay John Moore, Homewood, CA (US); Jonathan D. Baker, Compton, NH (US)

(73) Assignee: Sport Helmets, Inc.

( * ) Notice: Subject to any disclaimer, the term of this patent is extended or adjusted under 35 U.S.C. 154(b) by 1386 days.

(21) Appl. No.: 11/241,502

(22) Filed: Sep. 30, 2005

(65) Prior Publication Data

US 2006/0143805 A1 Jul. 6, 2006

Related U.S. Application Data

(60) Provisional application No. 60/614,671, filed on Sep. 30, 2004.

(51) Int. Cl.
*A62B 1/08* (2006.01)

(52) U.S. Cl. ..... 2/424

(58) Field of Classification Search ..... 2/410–411, 2/417–421, 425, 414, 9, 10, 6.3, 6.7, 422, 2/424

See application file for complete search history.

(56) References Cited

U.S. PATENT DOCUMENTS 3,787,895 A * 1/1974 Belvedere ..... 2/9
4,641,382 A 2/1987 Gessalin
4,907,300 A 3/1990 Dampney et al.
4,918,753 A 4/1990 Mermillod
5,301,372 A 4/1994 Matoba
5,365,946 A * 11/1994 McMillan ..... 128/861
5,502,843 A 4/1996 Strickland
5,555,567 A * 9/1996 Corpus ..... 2/424
5,956,776 A 9/1999 Chartrand
5,978,973 A 11/1999 Chartrand
6,047,400 A * 4/2000 Spencer ..... 2/9
6,202,223 B1 3/2001 Chartrand
6,490,729 B1 12/2002 Dondero
6,708,340 B1 3/2004 Dondero
6,807,679 B1 10/2004 Wang-Lee
7,434,268 B2 * 10/2008 Futch ..... 2/9

* cited by examiner

*Primary Examiner* — Tejash Patel
(74) *Attorney, Agent, or Firm* — H. Jay Spiegel

(57) ABSTRACT

A fastening element for securing a facemask to an outer shell of a protective helmet is disclosed. The fastening element comprises an end portion defining an aperture and a first tab and a second tab each flexibly connected to the end portion. The first tab defines a first tab aperture and the second tab defines a second tab aperture. The first tab and second tab also define a slot therebetween. A combination comprising a facemask and a fastening element is also disclosed. The facemask can comprise at least one substantially horizontal member and at least one substantially vertical member intersecting the substantially horizontal member. The fastening element is connectable to the facemask. Also disclosed is a helmet comprising an outer shell, a facemask and a fastening element for securing the outer shell to the facemask.

21 Claims, 7 Drawing Sheets

HELMET FASTENING ELEMENT

CROSS REFERENCE TO RELATED APPLICATION

This application claims the benefit of U.S. Provisional Application No. 60/614,671 filed Sep. 30, 2004, which is incorporated herein by reference.

FIELD OF THE INVENTION

The present invention relates to a fastening element, and more particularly, relates to a fastening element for securing the outer shell of a protective helmet to a facemask.

BACKGROUND INFORMATION

Helmets for use in a variety of sports as well as for various safety purposes, are well known. The purpose of a helmet is typically to reduce risk of injury of the head of the wearer in the event that the head is contacted with a direct force. Helmets used by those engaged in certain sports, such as lacrosse, typically have a hard protective outer shell that covers some type of energy-absorbing material. A wire facemask is typically attached to the protective outer shell to shield the wearer's face from a direct impact, such as being hit by a ball.

One of the problems associated with a direct impact on the facemask of a wearer, is that it can shift the orientation of the facemask with respect to the outer shell of the protective helmet. This can cause discomfort for the wearer as well as partially obscure the wearer's view. After impact, the facemask can be skewed such that the vertical or horizontal members comprising the facemask are positioned in front of the wearer's eyes thereby limiting the wearer's field of view. For example, when a lacrosse player is hit directly in the facemask by a lacrosse ball, the impact of the ball can shift the vertical members of the facemask in front of the line of sight of the wearer, thus inhibiting the player.

Conventional fasteners used to secure the facemask to the outer shell of the helmet have proved ineffective in preventing the facemask to misalign with respect to the protective outer shell after certain types of impact. Accordingly, a need remains for an improved fastening device that reduces misalignment between the facemask and the protective outer shell of a helmet after impact.

SUMMARY OF THE INVENTION

An aspect of the present invention is to provide a fastening element comprising an end portion defining an aperture, a first tab flexibly connected to the end portion, and a second tab flexibly connected to the end portion. The first tab defines a first tab aperture and the second tab defines a second tab aperture. The first tab and the second tab define a slot therebetween.

Another aspect of the present invention is to provide a combination comprising a facemask and a fastening element in which the fastening element is connectable to the facemask. The facemask comprises at least one substantially horizontal member, and at least one substantially vertical member intersecting said substantially horizontal member. The fastening element comprises an end portion defining an aperture, a first tab flexibly connected to the end portion, and a second tab flexibly connected to the end portion. The first tab defines a first tab aperture and the second tab defines a second tab aperture. The first tab and the second tab define a slot therebetween.

A further aspect of the present invention is to provide a helmet comprising an outer shell, a facemask, and a fastening element for securing the outer shell to the facemask. The facemask comprises at least one substantially horizontal member, and at least one substantially vertical member intersecting said substantially horizontal member. The fastening element comprises an end portion defining an aperture, a first tab flexibly connected to the end portion, and a second tab flexibly connected to the end portion. The first tab defines a first tab aperture and the second tab defines a second tab aperture. The first tab and the second tab define a slot therebetween.

These and other aspects of the present invention will be more fully understood following a review of this specification and drawings.

DETAILED DESCRIPTION

Figure 1:
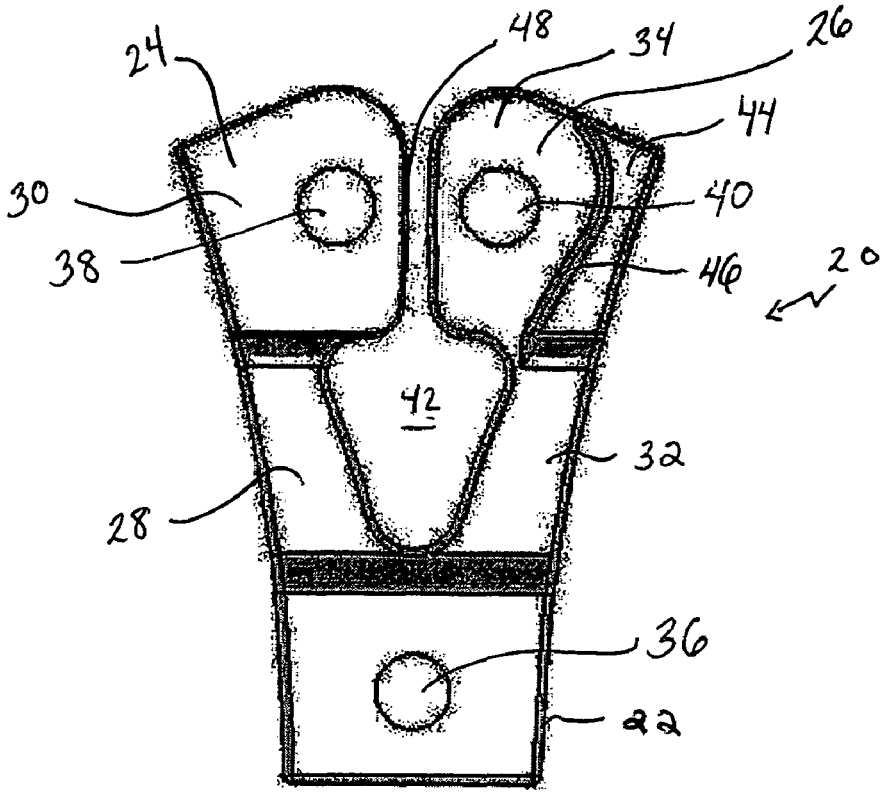
FIG. 1 is a top view of a fastening element in accordance with an embodiment of the present invention.

The fastening element of the present invention is capable of joining and stabilizing a protective mask, such as a facemask, with an outer protective shell of a safety helmet, such as a lacrosse helmet. As shown in FIG. 1, the fastening element 20 can comprise an end portion 22 and at least two tabs 24 and 26. The first tab 24 and the second tab 26 are flexibly connected to the end portion 22. In one embodiment, the first tab 24 comprises a middle section 28 and a tip section 30 and the second tab 26 comprises a middle section 32 and a tip section 34. The first tab 24 and the second tab 26 are structured and arranged to define a slot 42 therebetween. In one embodiment, the slot 42 is sized to allow a portion of a facemask (shown in FIGS. 4 and 6-8) to be received therewithin as will be discussed herein.

Still referring to FIG. 1, the end portion 22 comprises an aperture 36 extending through the end portion 22 of the fastening element 20. The first tab 24 can comprise a first tab aperture 38 extending through the first tab 24. The second tab 26 can comprise a second tab aperture 40 extending through the second tab 26. In one embodiment, the first tab aperture 38, the second tab aperture 40 and the aperture 36 are substantially the same size. The aperture 36, the first tab aperture 38 and the second tab aperture 40 can each be sized to allow a securing element (shown in FIGS. 6-8) to pass therethrough. In one embodiment, the second tab 26 can comprise a ridge 44 that extends above the plane of the second tab 26. The ridge 44 can have a profile 46 that corresponds to a profile 48 of at least a portion of the first tab 24 as will be discussed herein.

Figure 2:
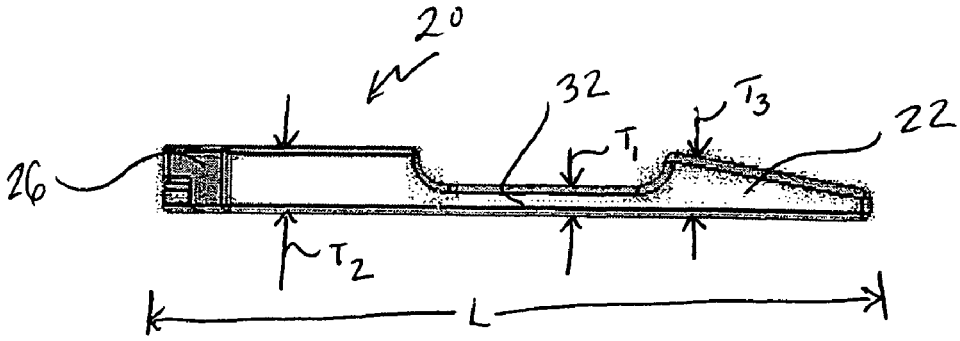
FIG. 2 is a side view of the fastening element shown in FIG. 1 in accordance with an embodiment of the present invention.

The fastening element 20 can have any suitable dimensions. In one embodiment, as shown in FIG. 2, the fastening element 20 can comprise an area of reduced thickness. In one embodiment, the middle sections 28 and 32 can have a reduced thickness $T_1$ as compared to the thickness $T_2$ of the tip sections 30 and 34. The middle sections 28 and 32 can have a thickness $T_1$ of from about 1/16 inches to about 3/16 inches. The tip sections 30 and 34 can have a thickness $T_2$ of from about 1/8 inches to about 1/4 inches. In another embodiment, the end portion 22 can have a thickness $T_3$ of from about 1/8 inches to about 1/4 inches. In another embodiment, the end portion 22 can be tapered. The fastening element 20 of the present invention can have a length L of from about 1 inch to about 3 inches, such as from about 2 1/4 inches to about 2 3/4 inches. As shown in FIG. 2, the fastening element 20 can have a low profile such that when it is installed on a helmet, it does not obstruct a wearer's view.

Referring again to FIG. 1, the end portion 22, the first tab 24 and the second tab 26 can comprise any suitable material, such as a polymeric material. In one embodiment, the end portion 22, the first tab 24 and the second tab 26 are each made of the same material. In another embodiment, the end portion 22, the first tab 24 and the second tab 26 can be co-extruded or co-molded. In another embodiment, the tip section 30 of the first tab 24 and the tip section 34 of the second tab 26 can be made of a different material than the middle section 28 of the first tab 24 and the middle section 32 of the second tab 26. The middle sections 28 and 32 can be made of a material that has a greater flexibility than the tip sections 30 and/or 34 and/or the end portion 22. In another embodiment, the end portion 22, the tip portions 30 and 34 and/or the middle sections 28 and 32 can comprise a material that is different from the rest of the fastening element 20.

In one embodiment, the fastening element can be a living hinge. The fastening element 20 can be molded out of a plastic material such as a blow-moldable high-density polyethylene (HDPE). HDPE can be a particularly suitable material for fastening element 20 because it decreases wear and improves durability of the fastening element by reducing stress risers in the fastening element at the point of flexure.

Figure 3:
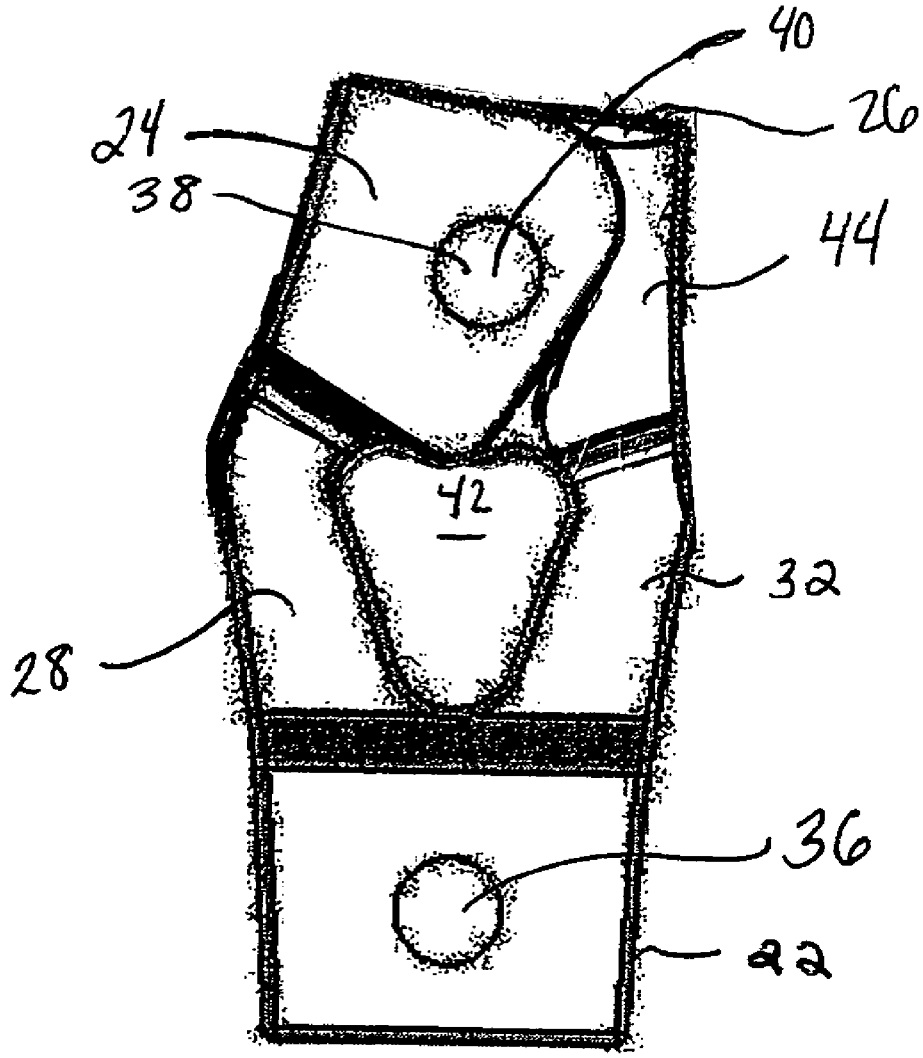
FIG. 3 is a top view of a fastening element in a partially engaged position in accordance with an embodiment of the present invention.

The fastening element 20 of the present invention can be partially engaged, as shown in FIG. 3. The first tab 24 can be structured to engage the second tab 26 by overlapping at least a portion of the second tab 26. In one embodiment, the first tab 24 can overlap the second tab 26 such that the first tab aperture 38 aligns co-axially with the second tab aperture 40. In one embodiment, the second tab 26 can comprise a ridge 44 extending beyond the plane of the second tab 26. In the partially engaged position, the profile 46 of the ridge 44 can contact at least a portion of the profile 48 of the first tab 24. In one embodiment, the ridge 44 can function as a guide to allow easier alignment of the first tab aperture 38 and the second tab aperture 40. In another embodiment, the ridge 44 can provide additional support for the fastening element 20. Although described herein as being located on the second tab 26, the ridge 44 can be positioned on the first tab 24 in the same fashion as described herein. It is also appreciated that the first tab 24 and second tab 26 can be constructed without a ridge in accordance with the present invention.

Figure 4:
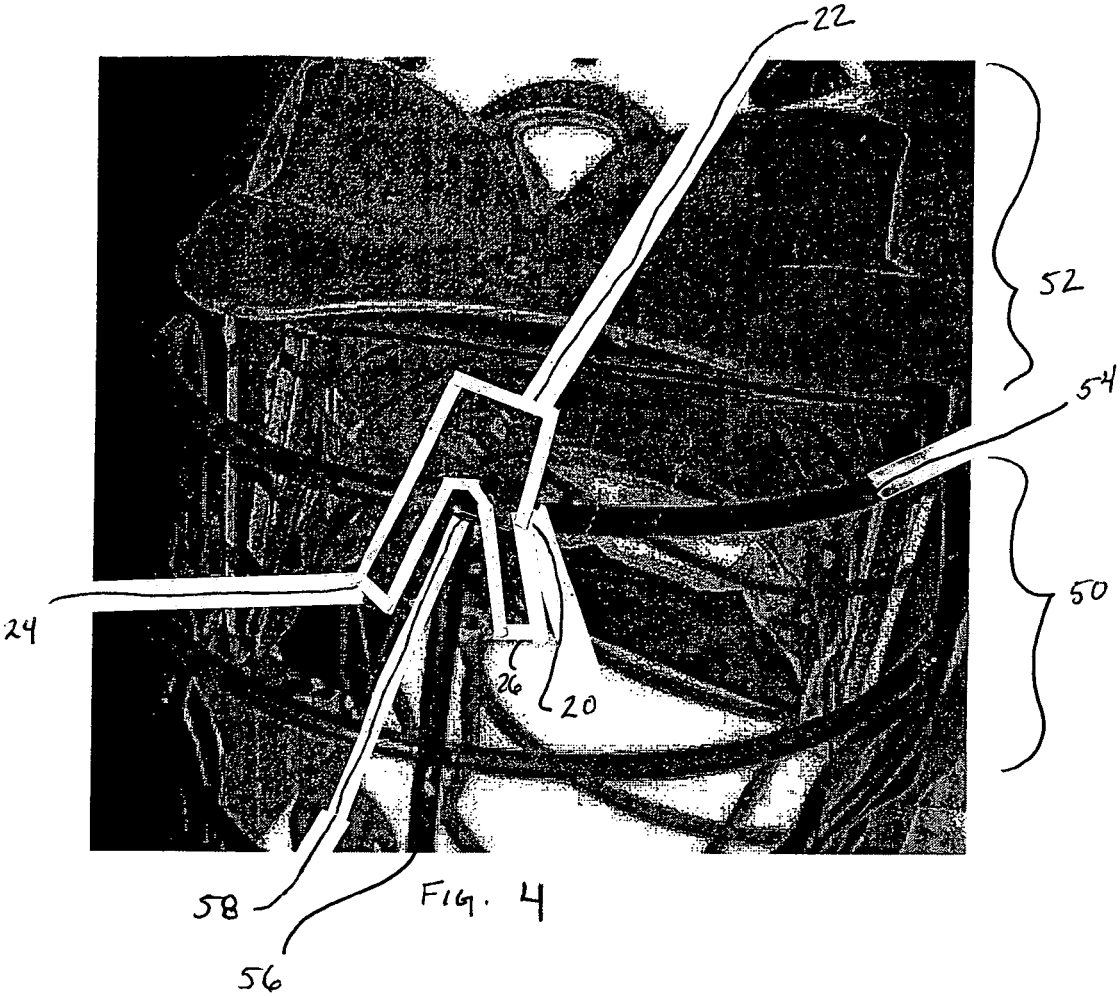
FIG. 4 is a partially perspective view of a fastening element in a partially engaged position with a substantially vertical member of a facemask disposed within the slot in accordance with an embodiment of the present invention.

As shown in FIG. 4, before the fastening element 20 is partially engaged, a portion of any suitable facemask 50 can be disposed within the slot 42. The facemask 50 of the present invention can be connectable to a helmet 52, such as a safety or sport helmet. In one embodiment, the facemask 50 comprises at least one substantially horizontal member 54 and at least one substantially vertical member 56 for protecting the face of the wearer. The facemask of the present invention can comprise a plurality of spaced apart substantially horizontal members 54 and/or a plurality of spaced apart substantially vertical members 56. The facemask 50 can comprise at least one intersection 58 of a substantially horizontal member 54 and a substantially vertical member 56. In one embodiment, the substantially vertical member 56 is welded to the substantially horizontal member 54 at the intersection 58.

Still referring to FIG. 4, a substantially vertical frame member 56 can be received within the slot 42 of the fastening element 20 before the fastening element 20 is partially engaged. Once the substantially vertical frame member 56 is positioned within the slot 42, the first tab aperture 38 of the first tab 24 can be co-axially aligned with the second tab aperture 40 of the second tab 26 as shown in FIG. 3. Once the fastening element 20 is partially engaged around a substantially vertical member 56, the fastening element 20 can be flexed such that the fastening element 20 is fully engaged. In the fully engaged position, the end portion 22 of the fastening element 20 can occupy a plane that is different than the plane of the first tab 24 and/or the second tab 26.

Figure 5:
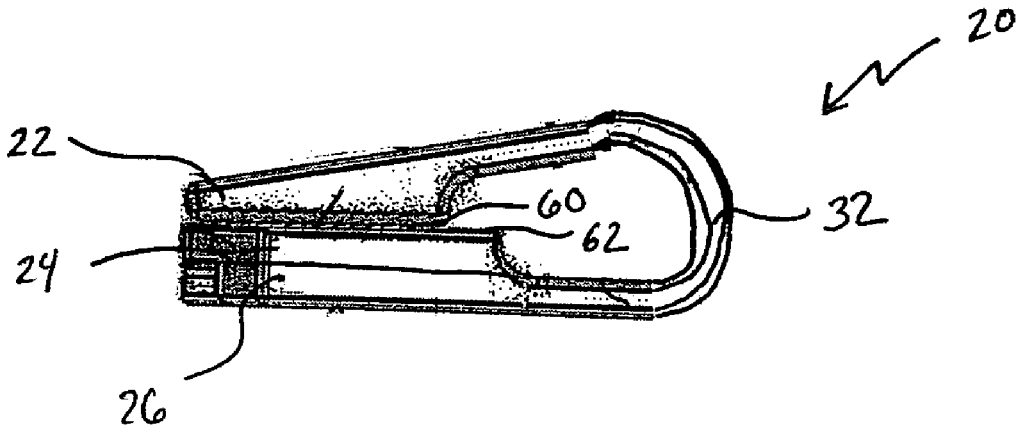
FIG. 5 is a side view of a fastening element in a fully engaged position in accordance with an embodiment of the present invention.

As shown in FIG. 5, the fastening element 20 can be flexed such that the end portion 22 can occupy a plane that is substantially parallel to the plane occupied by the first tab 24 and/or the second tab 26. In one embodiment, a first face 60 of the end portion 22 can contact a first face 62 of the first tab 24 as shown in FIG. 5.

Figure 6:
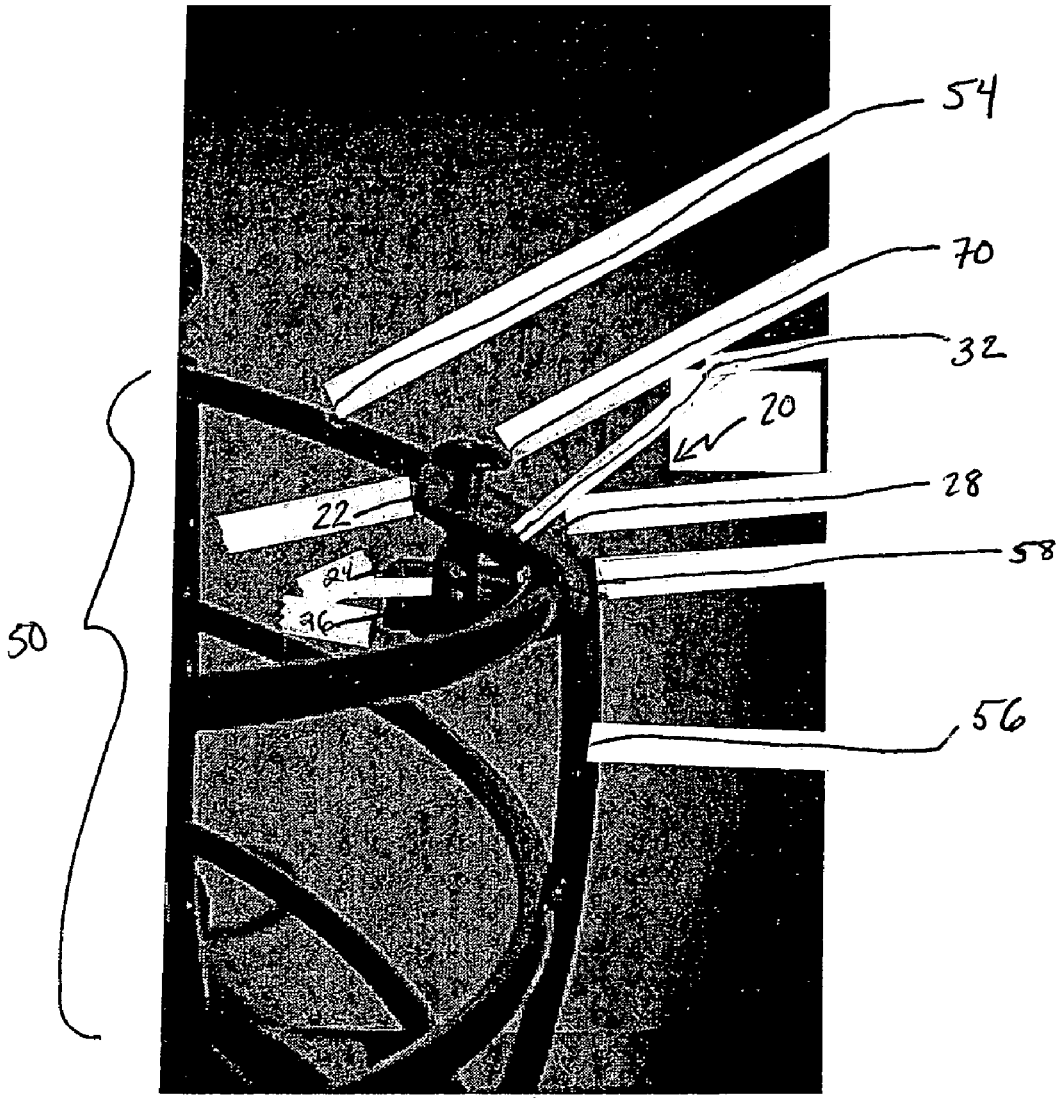
FIG. 6 is a partially perspective side view of fastening element in a fully engaged position about a substantially vertical member and a substantially horizontal member of a facemask in accordance with an embodiment of the present invention.

Once a substantially vertical member 56 is received within the slot 42 and the fastening element 20 is partially engaged, as shown in FIGS. 4 and 5, the fastening element can be fully engaged about a substantially horizontal member 54 of a facemask 50 as shown in FIG. 6. Once partially engaged about a substantially vertical member 56 as discussed above, the fastening element 20 can be flexed about an intersection 58 of the substantially vertical member and a substantially horizontal member 54. In this embodiment, the fastening element is flexed such that the aperture 36, the first tab aperture 38 and the second tab aperture 40 (shown in FIG. 1) are each co-axially aligned and the end portion 22 and the middle section 28 of the first tab 24 and the middle section 32 of the second tab 26 are at least partially disposed about the horizontal frame member 54 as shown in FIG. 6. A securing element 70 can be at least partially inserted into at least one of the aperture 36, the first tab aperture 38 and/or the second tab aperture 40 to secure the end portion 22 to the first tab 24 and/or the second tab 26. In one embodiment, the securing element 70 can be at least partially inserted into each of the aperture 36, the first tab aperture 38 and the second tab aperture 40. In another embodiment, the securing element 70 can be integrally formed with the end portion 22. Any suitable securing element 70 can be used with the present invention. Example securing elements 70 include screws, bolts, rivets, dowels, nails, pins, snaps and the like. It is appreciated herein that corresponding retaining elements such as nuts, washers, and grommets can be used in accordance with the securing element as is conventionally known.

Figure 7:
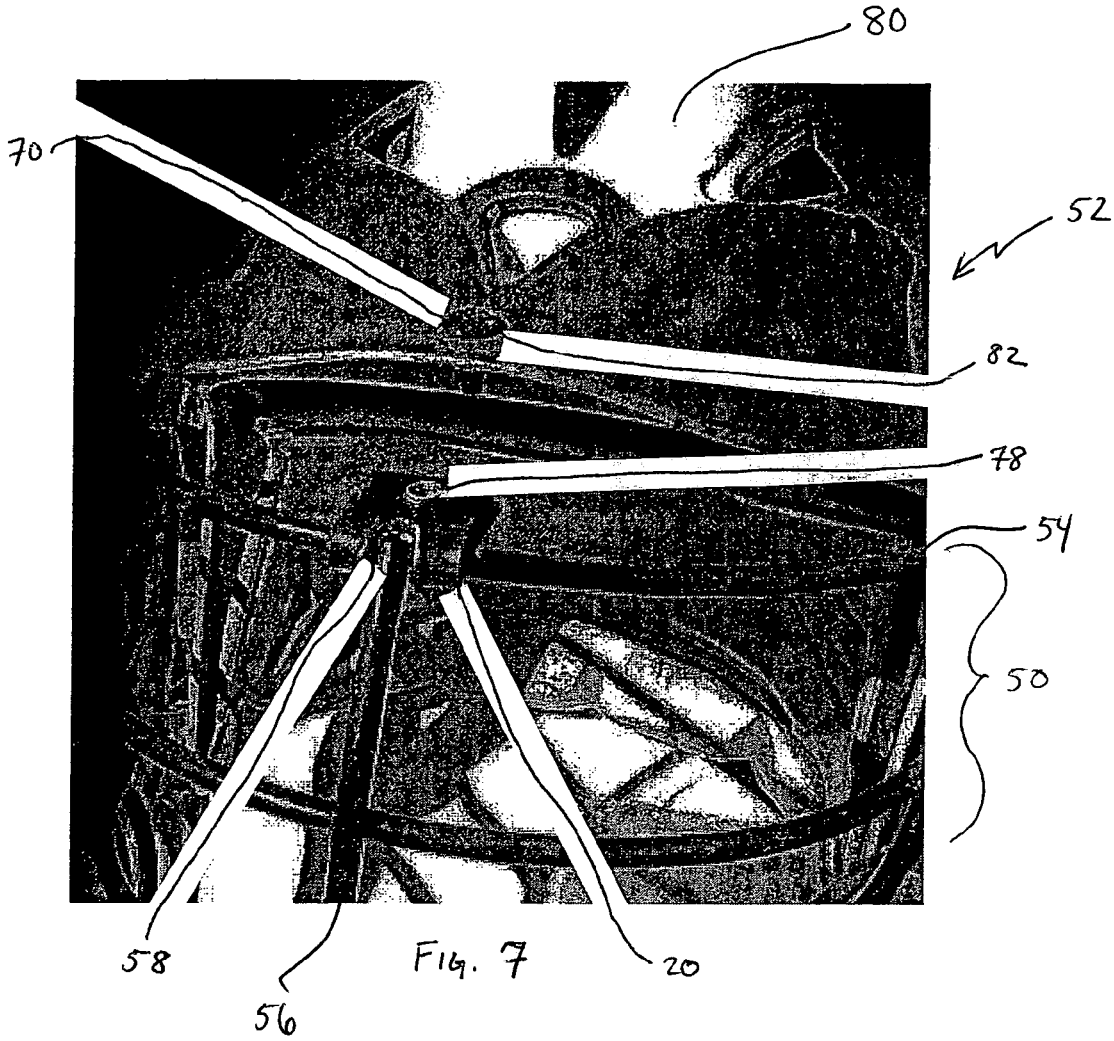
FIG. 7 is a partially perspective view of a partially assembled helmet, facemask and fastening element in accordance with an embodiment of the present invention.

In one embodiment, as shown in FIG. 7, a receiving insert 78 can be disposed within the aperture 36, the first tab aperture 38 and/or the second tab aperture 40 to further secure the securing element 70. In one embodiment, the receiving insert 78 can comprise a threaded insert or a solid material that can be compressed upon insertion of the securing element into the aperture 36, the first tab aperture 38 and/or the second tab aperture 40.

As shown in FIG. 7, a helmet 52 such as a lacrosse helmet, can comprise an outer shell 80, which may optionally include a visor, a facemask 50 comprising at least one substantially vertical member 56 and at least one substantially horizontal member 54 which intersect at an intersection 58, and a fastening element 20 as described herein. The fastening element 20 can secure the facemask 50 to the outer shell 80. In one embodiment, the outer shell 80 can be configured to have a shell aperture 82 that is alignable with at least one of the aperture 36, the first tab aperture 38 and/or the second tab aperture 40 (shown in FIG. 1). In another embodiment, the shell aperture 82 is alignable with each of the aperture 36, the first tab aperture 38 and the second tab aperture 40 (shown in FIG. 1). In another embodiment, the shell aperture 82 is alignable with a receiving insert 78 disposed within each of the aperture 36, the first tab aperture 38 and the second tab aperture 40. A securing element 70 can be inserted into the shell aperture 82 and the aperture 36, the first tab aperture 38 and/or the second tab aperture 40 (shown in FIG. 1) to secure the helmet 52 with the facemask 50.

Figure 8:
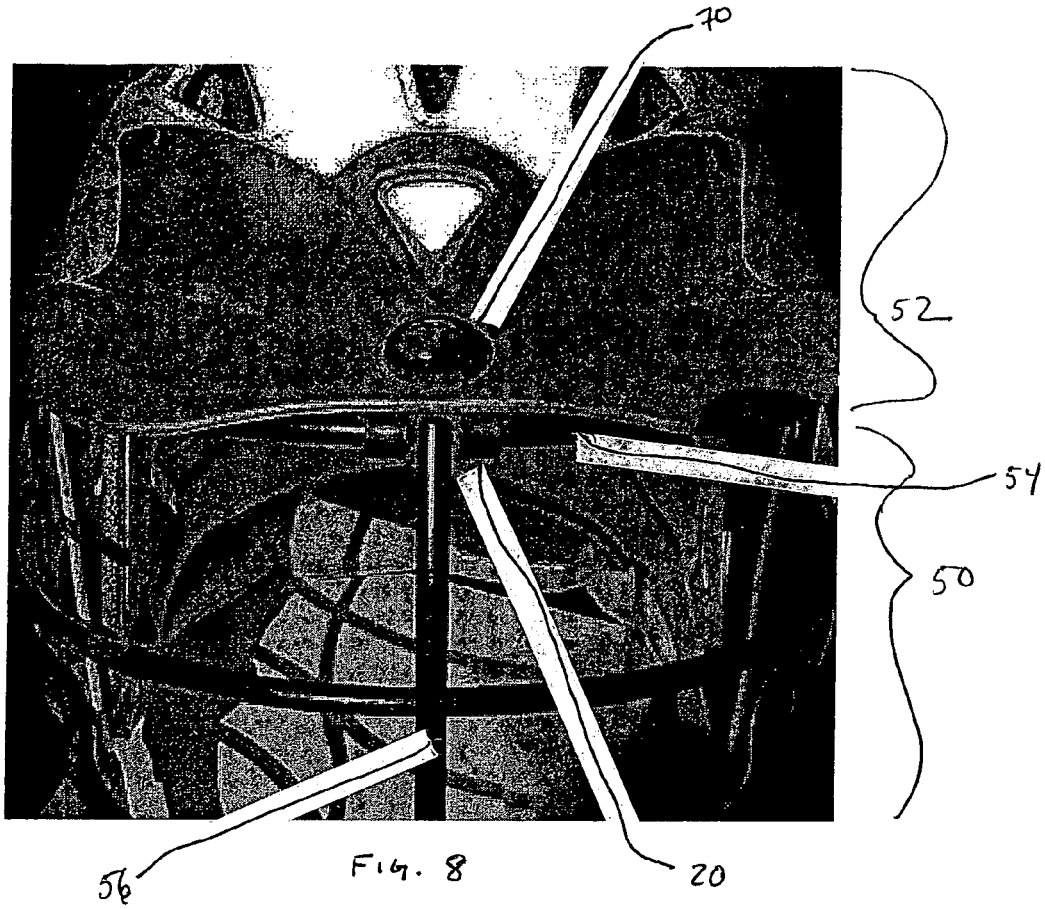
FIG. 8 is a partially perspective view of fully assembled helmet, facemask and fastening element in accordance with an embodiment of the present invention.

As shown in FIG. 8, when the fastening element 20 is fully engaged the outer shell 80 of a helmet 52 can be secured to the facemask 50. The fastening element 20 can be disposed to at least partially surround both a substantially vertical member 56 and a substantially horizontal member 54. The middle section 28 of the first tab 24 can be disposed on one side of the substantially vertical member 56 and the middle section 32 of the second tab can be disposed on the opposite side of the substantially vertical member 56. This allows the facemask 50 to resist at least movement (side to side or up and down) with respect to the outer shell 80 when impacted by a direct force, such as a lacrosse ball. Upon impact, the fastening element 20 limits movement of the facemask 50 with respect to the outer shell 80 from substantial alterations in the leftwards and rightwards directions as well as forward and backwards directions. The fastening element 22 of the present invention further eliminates the need for two or more fastening devices to secure a facemask to the helmet.

Whereas particular embodiments of this invention have been described above for purposes of illustration, it will be evident to those skilled in the art that numerous variations of the details of the present invention may be made without departing from the invention as defined in the appended claims.

What is claimed is:

1. A fastening element, comprising:

a) a Y-shaped body having a first end and a second end;

b) said first end having an end portion with a first aperture therethrough;

c) a middle section connected to said end portion, said middle section comprising a first flexible web and a second flexible web defining a slot therebetween;

d) said second end including a first tab and a second tab connected to said first and second webs respectively, said first tab having a second aperture therethrough and said second tab having a third aperture therethrough e) said element having a first relatively flat configuration in which said tabs are laterally spaced, said element being movable to a second configuration in which said tabs are stacked and said end portion is folded over said tabs.

2. The element of claim 1, wherein said second and third apertures are axially aligned when said tabs are stacked.

3. The element of claim 2, wherein said end portion is generally rectangular, said end portion being movable to a position at which said first, second and third apertures are axially aligned.

4. The element of claim 1, wherein in said second configuration, said first, second and third apertures are axially aligned.

5. The element of claim 4, wherein in said second configuration, an elongated bar is captured in said slot.

6. The element of claim 4, wherein in said second configuration, two connected bars are captured in said slot.

7. The element of claim 6, wherein said bars are part of a face mask of a helmet.

8. The element of claim 1, wherein said element is made of plastic.

9. The element of claim 8, wherein said plastic comprises high density polyethylene.

10. The element of claim 1, wherein said end portion has a first thickness and said webs have a second thickness less than said first thickness.

11. The element of claim 2, wherein said second tab has a peripheral raised ridge, said first tab having an edge engaging said ridge when said tabs are in said stacked configuration with said second and third apertures aligned.

12. In a helmet having a shell and a face mask having a plurality of interconnected bars including an intersection between two interconnected bars, the improvement comprising a fastening element for interconnecting said face mask to said shell comprising:

a) a Y-shaped body having a first end and a second end;

b) said first end having a relatively thick end portion with a first aperture therethrough;

c) a relatively thin middle section connected to said end portion, said middle section comprising a first web and a second web defining a slot therebetween adapted to receive at least one bar of a face mask of a helmet;

d) said second end including a first tab and a second tab connected to said first and second webs respectively, said first tab having a second aperture therethrough and said second tab having a third aperture therethrough.

13. The improvement of claim 12, wherein said first and second webs are flexible, whereby said first and second tabs are movable to a stacked configuration in which said second and third apertures are axially aligned and at least one of said bars is captured in said slot.

14. The improvement of claim 13, wherein said end portion is generally rectangular, said end portion being movable to a position at which said first, second and third apertures are axially aligned and said intersection is captured in said slot.

15. The improvement of claim 12, wherein said webs are flexible, said element having a first relatively flat configuration in which said tabs are laterally spaced, said element being movable to a second configuration in which said tabs are stacked and said end portion is folded over said tabs with said intersection captured in said slot.

16. The improvement of claim 15, wherein in said second configuration, said first, second and third apertures are axially aligned and a fastener extends through said aligned apertures to fasten said face mask to said shell.

17. The improvement of claim 12, wherein said element is made of plastic.

18. The improvement of claim 17, wherein said plastic comprises high density polyethylene.

19. The improvement of claim 12, wherein said tabs have a first thickness and said webs have a second thickness less than said first thickness.

20. A fastening element, comprising:

a) a Y-shaped body having a first end and a second end;

b) said first end having an end portion with a first aperture therethrough;

c) a middle section connected to said end portion, said middle section comprising a first web and a second web defining a slot therebetween;

d) said second end including a first tab and a second tab connected to said first and second webs respectively, said first tab having a second aperture therethrough and said second tab having a third aperture therethrough;

e) said end portion having a first thickness and said webs having a second thickness less than said first thickness.

21. A fastening element, comprising:

a) a Y-shaped body having a first end and a second end;

b) said first end having an end portion with a first aperture therethrough;

c) a middle section connected to said end portion, said middle section comprising a first flexible web and a second flexible web defining a slot therebetween;

d) said second end including a first tab and a second tab connected to said first and second webs respectively, said first tab having a second aperture therethrough and said second tab having a third aperture therethrough;

e) said first and second tabs being movable to a stacked configuration in which said second and third apertures are axially aligned, said second tab having a peripheral raised ridge, said first tab having an edge engaging said ridge when said tabs are in said stacked configuration with said second and third apertures aligned.

* * * * *